United States Patent [19]

Nayfa

[11] 4,019,225

[45] Apr. 26, 1977

[54] MILL FIBER TREATMENT APPARATUS

[76] Inventor: James E. Nayfa, 5015 Sharp St., Dallas, Tex. 75247

[22] Filed: June 6, 1975

[21] Appl. No.: 584,300

Related U.S. Application Data

[62] Division of Ser. No. 327,730, Jan. 29, 1973, Pat. No. 3,894,314.

[52] U.S. Cl. ..... 19/66 R; 134/57 R

[51] Int. Cl.[2] ..... D01G 37/00

[58] Field of Search ..... 19/7, 105, 66 R, 145.5; 134/57 R, 58 R; 118/410

[56] References Cited

UNITED STATES PATENTS

| | | | |
|---|---|---|---|
| 1,071,069 | 8/1913 | Marx | 19/66 R |
| 1,642,092 | 9/1927 | Smith | 19/66 R X |
| 2,589,008 | 3/1952 | Lannan | 19/66 R X |
| 2,809,772 | 10/1957 | Weisz | 118/410 X |
| 2,873,483 | 2/1959 | Lytton | 19/66 R |
| 3,071,202 | 1/1963 | Lytton et al. | 19/145.5 X |
| 3,351,984 | 11/1967 | Wheelock | 19/66 R |

FOREIGN PATENTS OR APPLICATIONS

| | | | |
|---|---|---|---|
| 251,936 | 12/1926 | United Kingdom | 19/66 R |

*Primary Examiner*—Dorsey Newton
*Attorney, Agent, or Firm*—Peter J. Murphy

[57] ABSTRACT

Fibers enter a textile mill at bale breaking equipment where fibers are distributed onto an open conveyor, and possibly blended, for transmittal to processing machinery such as opening and cleaning equipment, picker equipment for forming a lap, carding equipment, and drawing, roving and spinning equipment. The fibers are carried on the open conveyor past a spray station including at least one nozzle for spraying a finely diffused liquid onto the surface of the fiber material carried on the conveyor. The liquid is an aqueous solution which consists of about 75% water and about 12½% of animal or vegetable fats as an active compound which is converted ionic salt by reaction of the organic acids contained in the animal and vegetable fats with an amine and subsequently with an alkyl sulfate. After passing the spray station, the fiber material may be transmitted through pneumatic conveyor systems to the additional processing equipment which ultimately converts the fibers into yarn or thread. An automatic control system for the spray station is energized by activation of either the bale breaking machinery or the open conveyor, and provides a delay control allowing the fibers on the open conveyor to move from the opening machinery station to the spray station.

8 Claims, 3 Drawing Figures

MILL FIBER TREATMENT APPARATUS

RELATED APPLICATION

This is a division of application Ser. No. 327,730, filed Jan. 29, 1973, now U.S. Pat. No. 3,894,314, entitled TREATMENT OF SPINNING FIBERS IN A TEXTILE MILL.

BACKGROUND AND SUMMARY OF THE INVENTION

This invention relates to apparatus in a textile mill for treating fibrous material, prior to handling by mill equipment preparatory to and in connection with the converting of fibers to yarn or thread.

In the processing of fibrous material, such as cotton fibers, from the point of entry into a mill to the formation of a yarn or thread suitable for weaving, the fibers pass through a sequence of equipment performing the functions of opening up of the fibers from the compressed state in the incoming bales, separating dirt and other foreign matter from the fibers, parallelizing and drawing out the fibers to convert the individual fibers from a tangled mass into generally parallel alignment suitable for the formation of continuous slivers, and further drawing out of the slivers, and twisting and spinning the slivers, to ultimately produce the yarn or thread suitable for the subsequent weaving processes. During these several processes, the fibers are subjected to much mechanical handling by the components of the equipment which inherently produce much friction between the machine parts and the fiber material. Conditions of high friction and sticking of the fiber material are aggravated where the material has a high sugar content and where there is a higher than normal dirt or contamination contained in the fiber.

Another undesirable condition, in this machinery is the inherent build up of static electricity due to friction which causes further tendency of the fibers to stick together to resist separation of foreign matter, to resist the desired actions of the processing equipment resulting in increased fiber breakage which reduces the quality of the yarns. Because of these inherent conditions and problems with the fiber processing equipment, there is ultimately an end loss of spinnable fibers and a reduction in yarn strength due to the higher percentage of short fibers.

An inherent result from excessive friction in equipment of this type is that the wear of the equipment is increased resulting in the frequent necessity for replacement of parts and also resulting in overall reduced life.

A principal object of this invention therefore is to provide apparatus for the treating of fibers in a textile mill which, improves the subsequent processing of the fibers through the various equipment of the mill by improving the conditions which result in the above outlined disadvantages.

Another principal object is to provide apparatus which may be used in conjunction with the conventional mill equipment for treating the fibers to eliminate or improve on these problems.

A further object of this invention is to provide spray apparatus for applying a fine mist spray of a selected solution to the surface of the fibrous material at an early stage in mill processing, so that the subsequent processing operations may be carried out in an improved and efficient manner.

Still another object of this invention is to provide a system whereby the application of a spray solution to the material is automatically controlled by bale opening equipment which distributes the incoming fiber material onto a conveyor for the spray treatment and for delivery to subsequent processing equipment.

Apparatus for the treatment of fibrous material includes a powered conveyor; powered apparatus for distributing the fibrous material uniformly onto the conveyor; spray apparatus including at least one nozzle for spraying a finely diffused liquid on the fibrous material carried on such conveyor, said spray apparatus being disposed adjacent to the conveyor at a point spaced from said powered distributing apparatus; and control means responsive to the operation of the distributing or conveying apparatus for effecting the operation of the spray apparatus.

A principal feature of the apparatus of the invention is that the fibrous material is treated with a treatment composition, at a stage in its processing prior to handling by various stages of equipment, which better conditions the fibers for the subsequent processing by the equipment and has the side effect of being deposited on the equipment to further reduce problems which inherently result from the processing. The treatment compound is added to the material in such quantities as to provide a synthetic shield or coating on the fibers to preserve the inherent quality of the fibers which is often dissipated through the friction generated as the fibers are carried through and acted on by the processing equipment. The treatment composition provides lubricity of the fibers and functions to greatly minimize the build up of static electricity which is generated by the movement of the fibers through the processing equipment. The treatment composition is of a nature that a portion will be deposited from the fibrous material to the parts of the equipment which act on the fibers, thereby coating such parts to further minimize the friction between the fibers and equipment parts and to inherently then reduce the wear of such equipment parts.

The novel features and the advantages of the invention, as well as additional objects thereof, will be understood more fully from the following description when read in connection with the accompanying drawings.

DRAWINGS

DESCRIPTION OF THE PREFERRED EMBODIMENT

Figure 1:
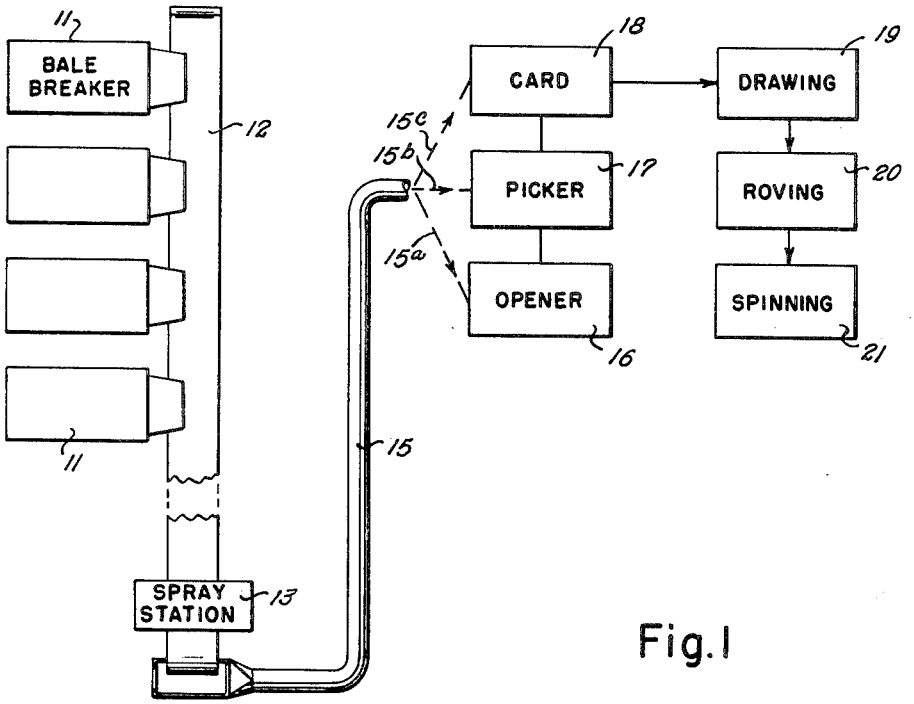
FIG. 1 is a diagrammatic illustration of apparatus used in a textile mill, with which the invention is practiced.

FIG. 1 of the drawing is a diagrammatic illustration, somewhat in the form of a flow diagram, illustrating typical processing equipment in a textile mill concerned with the spinning of cotton fibers for example.

The four units 11 identified as bale breakers act on hard compressed slabs of fibers from the bale to reduce these fibers to a fairly fluffy state, and then distribute the fibers at a controlled rate to a belt conveyor 12. During this process some of the dirt and trash contained in the cotton lint or fibers may be removed. The individual bale breakers may be used to process cotton or other materials of different quality so that a desired blend is discharged to the conveyor belt 12. It is also possible at this point of entry to a textile mill, that other fibrous material, such as synthetic fibers, may be blended with cotton at this stage.

The fibers are deposited relatively uniformly onto the open conveyor belt 12, and are conveyed through a spray station 13. A liquid solution is deposited on the surfaces of the fibers by means of one or more spray nozzles, in the form of a finely diffused spray. The conveyor 12 may be of some length such as 20 or 30 feet for example in order to convey the material from the atmosphere of the bale breaking room to an atmosphere more suitable for the spraying operation. Following the spraying, the fiber material is discharged into the entry hopper of a pneumatic conveyor duct 15.

The equipment to which the fibers are conveyed will vary from plant to plant, and, as indicated by the dotted lines 15*a*, 15*b* 15*c* the material may alternatively be conveyed to opening equipment 16, picker equipment 17 or carding equipment 18. If opening equipment is provided the fibers will first be processed with this equipment which functions to further open up the fluffed cotton and to permit additional cleaning of the cotton fibers. The fibers may then be processed by picker equipment 17 which further cleans the cotton fibers and forms the cotton into a substantially uniform and fairly dense batt or lap suitable for handling by carding equipment 18. In some plants, the cotton fibers are fed directly from a pneumatic conveyor 15 to suitable chute feed devices for the carding equipment 18.

The fibrous material which is received at the inlet of the carding equipment in the form of a relatively thick batt or lap has a uniform density. The carding equipment receives these batts at a relatively slow rate and combs or aligns the individual fibers to form a fine delicate web at the output end. This fine web is funneled into one or more so-called trumpets which shape the web into a round sliver having a diameter of approximately ½ inch for example. The slivers are coiled into cans for transport to the next processing equipment.

The slivers may be processed through several stages of drawing equipment 19 wherein the sliver is reduced in diameter and density and where the fibers are further parallelized and the regularity of the weight per unit length of the material is increased. Roving equipment 20 also reduces the sliver to smaller and smaller diameters and twists it slightly to maintain a continuous strand. The last indicated equipment in the flow cycle is the spinning equipment 21 which further draws the fibers and twists the fibers to produce yarn or thread.

In all of the stages of processing of the fibers there is inherent friction between the fibers and the elements of the equipment which act on the fibers. This friction inherently produces wear on the equipment parts which come in contact with the fibers. This friction causes a build up of static electricity which acts between the fibers being processed to resist separation of the fibers and to resist removal of seed fragments and other contamination during the cleaning processes, and which acts between the fibers and the machine parts to increase drag of the material or sticking of the material to the several parts. Sticking is further caused by high sugar content and other contamination within the fibrous material with this problem being aggravated by the static electricity which resists the removal of these contaminants.

According to applicant's invention, a solution of a treatment composition is introduced to the surface of the fibers at a point in the processing prior to the handling by much of the equipment. The treatment composition serves to give the fibers a certain lubricity, and has anti-static properties to reduce to a large extent the build up of static electricity.

A preferred solution for this purpose is an aqueous solution consisting of about 75% water for example and further consisting of animal or vegetable fats as an active compound which is converted to ionic salt by reaction of the organic acids contained in the animal and vegetable fats with an amine and subsequently with an alkyl sulfate.

A preferred formulation for the solution is as follows, with the percentage of ingredients by weight being indicated:

| | |
|---|---|
| Tallow imidazolinium methosulfate | 12½% |
| Ethyl sulfate $C_2H_5SO_4$ | 7% |
| Dimethyl distearyl ammonium chloride $[(CH_3)_2(C_{18}H_{37})_2N^+]Cl-$ | 5½% |
| Water | 75% |
| | 100% |

In this formulation the basic formula for tallow imidazolinium methosulfate is as follows:

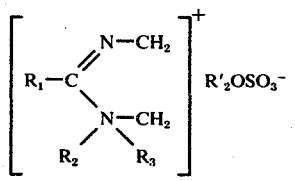

wherein R1 is an aliphatic hydrocarbon radical (C 10–20), wherein R2 is a saturated aliphatic hydrocarbon radical (C 2–6), wherein R3 is a aliphatic alcohol (C 1–5), and wherein R'2 is an alkyl sulfate (C 2–5).

The dimethyl distearyl ammonium chloride functions as a lubricating constituent of the composition.

Figure 2:
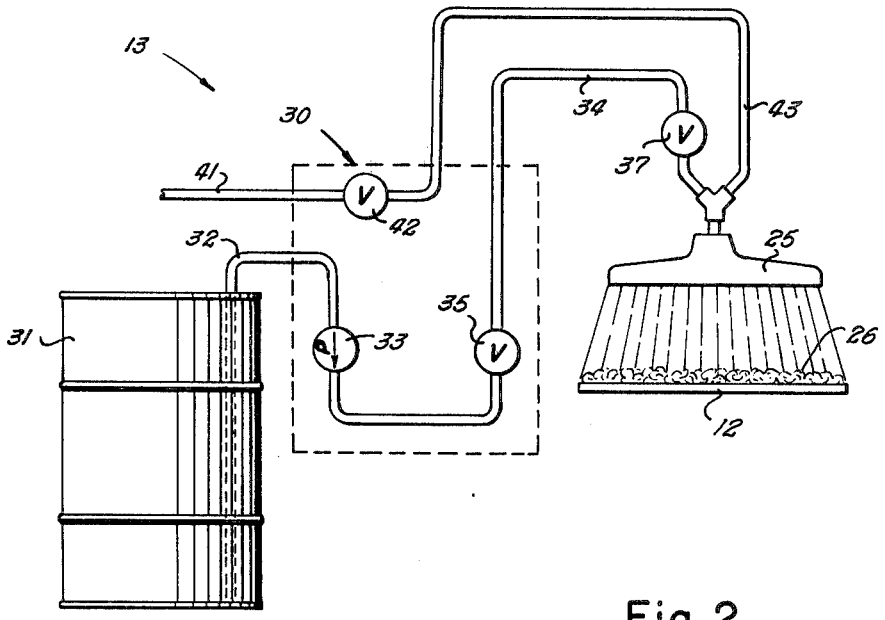
FIG. 2 is a diagrammatic illustration of the spray station identified in FIG. 1.

The spray station 13 is illustrated diagrammatically in FIG. 2 wherein there is shown a spray nozzle 25 positioned above the belt conveyor 12 to spray treating solution onto fibrous material 26. FIG. 2 is essentially a schematic diagram of the hydraulic circuit for supplying the treating solution and air to the nozzle 25 and indicates, in broken lines, a spray control unit 30 which controls the spray station and houses certain components.

The treatment solution may be supplied to the mill in a 55 gallon drum 31, for example. A conduit 32 associated with the control unit 30 is the suction line to a pump 33, which may be an electric motor driven, positive displacement fluid pump. Pump outlet conduit 34 directs the solution through solenoid controlled shut off valve 35 to the nozzle 25. Adjacent to the nozzle 25 the fluid is directed through a pressure responsive cut off valve 37 which functions to open in response to a supply pressure of about 9 psi for example and to close when the pressure drops below that value. This valve maintains solution in the discharge conduit and prevents leakage of the liquid from the nozzle.

To effect the dispensing of the liquid from the nozzle in the desired fine mist spray, pressurized air is supplied to the nozzle at a pressure of 16 to 30 psi for example, This air is preferably supplied from plant air if available; or a supplementary air compressor may be associated with the spray station. In the diagrammatic illustration of FIG. 2, air is supplied from either plant air or a compressor through inlet conduit 41, to solenoid actuated on-off valve 42 within the control unit 30, then through supply conduit 43 to the nozzle 25.

Figure 3:
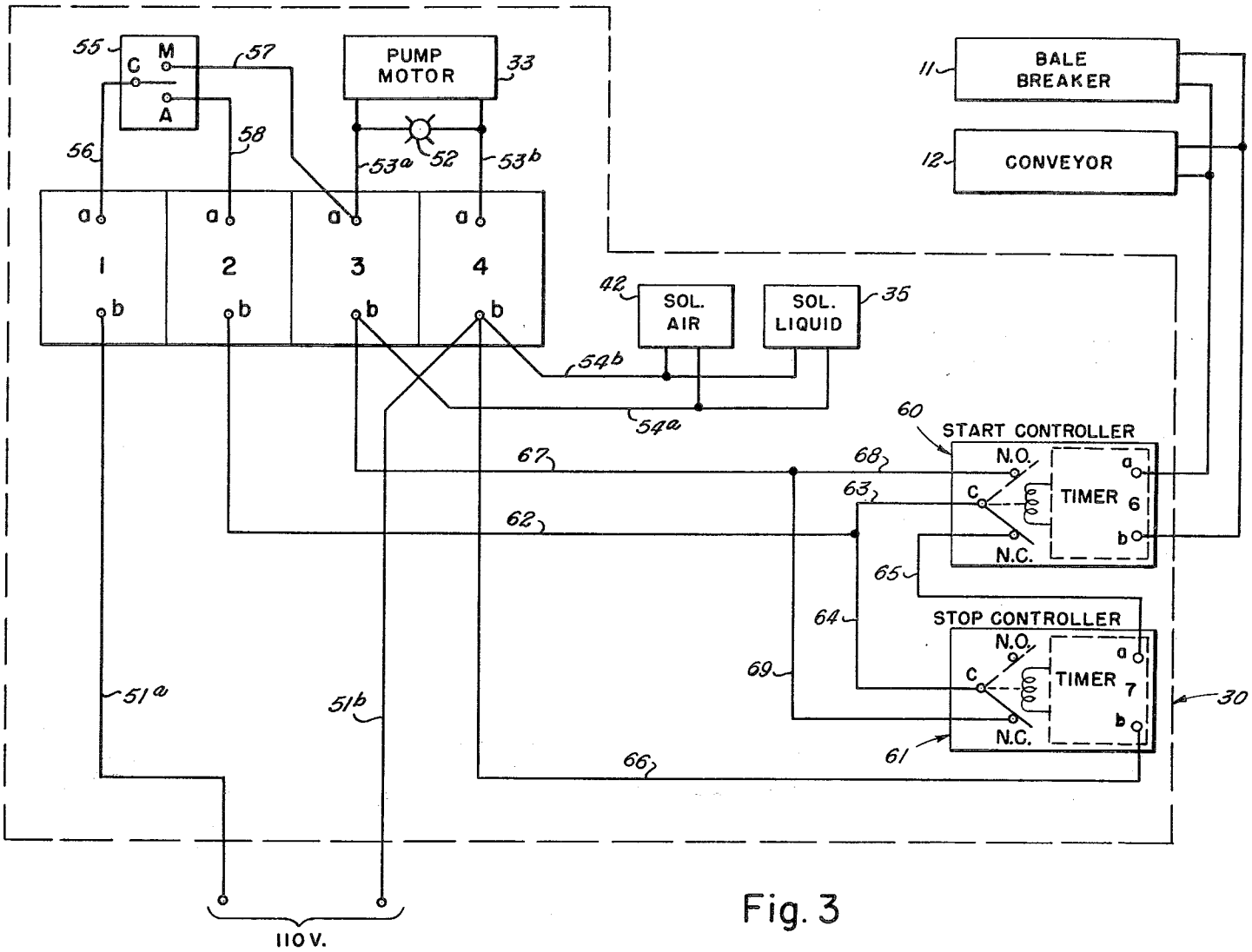
FIG. 3 is a schematic diagram of the control circuit embodied in the console control unit at the spray station.

FIG. 3 of the drawing is a schematic diagram of the electric control circuit for the control unit 30, and associated circuitry. The spray control unit 30 may be a housing containing the circuit components to be described as well as other components such as the liquid pump 33 and solenoid valves.

For internal wiring of the components within the control unit, a terminal panel includes four terminal blocks designated 1, 2, 3 and 4 and each having a pair of interconnected terminal posts *a* and *b*. Power for the control unit is supplied through terminal blocks 1 and 4 by means of conductors 51*a* and 51*b* which are connected to a conventional 110 volt AC power supply for example.

The several components which are to be energized to dispense treatment solution are the electric motor driven pump 33, the solenoid controlled liquid valve 35, solenoid controlled air valve 42, and a pilot light 52. All of these components are connected across the terminal blocks 3 and 4, the pump and the pilot light being connected by means of conductors 53*a* and 53*b*, and solenoid valves 35 and 42 being connected by means of conductors 54*a* and 54*b*. The terminal block 4 and connected conductors 51*b*, 53*b* and 54*b* will be referred to for convenience as the "ground circuit"; while conductor 51*a* and terminal blocks 1, 2 and 3 are associated with the "power circuit".

A selector control switch 55 has its common terminal C connected to block 1 through conductor 56, has a terminal M connected to block 3 through conductor 57, and has a terminal A connected to block 2 through conductor 58. For manually operating the spray station, the selector switch connects its terminals C and M thereby connecting block 3 in the power circuit to energize the spray station components. For automatic operation, the selector switch 55 connects its terminals C and A thereby connecting block 2 in the power circuit and disconnecting block 3.

Automatic operation is controlled through start controller 60 having input terminals 6*a* and 6*b* and a stop controller 61 having input terminals 7*a* and 7*b*. Start controller 60 includes a solenoid operated switch arm which is normally positioned to couple its common terminal C and its contact NC; and which, when the controller is energized, couples the terminals C and contact NO. The controller includes an adjustable timer to select a delay interval prior to movement of the switch arm from the NC to the NO contact.

Similarly the stop controller 61 includes a solenoid operated switch arm normally coupling its common terminal C and its contact NC, and which shifts to make its contact NO when the controller is energized and after a preselected delay interval through an associated adjustable timer.

These controllers are connected into the circuit in the following manner. The common terminal C of both the start controller and the stop controller are connected to the block 2 through conductors 62, 63 and 64. The start controller NC contact is connected to the input terminal 7*a* of the stop controller through conductor 65; and the other input terminal 7*b* is connected into the ground circuit through conductor 66 and terminal block 4. The start controller NO contact is connected to block 3 through conductors 67 and 68; stop controller NC contact is also connected to block 3 through conductors 67 and 69.

The input terminals 6*a* and 6*b* for the start controller are connected in the power circuit for either the bale breakers 11 or the conveyor 12, so that when power is supplied to this equipment power is simultaneously supplied to energize the start controller. By the same token when the power to this equipment is shut off, the start controller is deenergized.

Operation

The start controller 60 and the stop controller 61 function together to couple terminal blocks 2 and 3 at the desired time, to switch terminal block 3 into and out of the power circuit for energizing the operating components of the spray control unit. This portion of the circuit operates in the following manner. When the selector switch 55 is placed in the automatic position, the power circuit is extended through terminal conductors 62 and 63, the start controller NC contact, and conductor 65 to energize the stop controller 61. After the preselected delay interval, the stop controller switch arm breaks from its NC contact; and at this point block 3 is not connected in the power circuit. This is the "ready" condition of the control circuit.

Now when power is supplied to the bale breakers 11 or conveyor 12, power is also supplied to terminals 6*a* and 6*b* to energize the start controller. After the preselected delay interval, allowing time for fibers to move along the conveyor from the bale breakers 11 to the spray station 13, the switch arm swings over to make the NO contact. This couples blocks 2 and 3 in the power circuit through conductors 62, 63, 68 and 67; and the spray control unit components are energized to dispense the treatment solution. With the breaking of the start controller NC contact, power to the stop controller 61 through the input terminal 7*a* is removed, and its switch arm immediately makes its NC contact. This completes a parallel power circuit coupling blocks 2 and 3 consisting of conductors 62, 64, 69, and 67. This condition of the spray control circuit will be maintained until such time as the power supply to the bale breakers 11 and conveyor 12 is removed.

When this occurs, the start controller is deenergized resulting to an immediate breaking of its NO contact and an immediate making of its NC contact, the latter of which again completes the power circuit for energizing the stop controller. With the breaking of the start controller NO contact, one of the parallel power circuits coupling terminal blocks 2 and 3 is broken; however the second power circuit through the stop controller is maintained for the preselected delay interval following energization of the stop controller. This interval allows time for the last fibers placed on the conveyor belt by the bale breakers to reach the spray station 23, at which time the stop controller NC contact breaks to open the power circuit to the terminal block 3 thereby shutting down the spray unit. This operating cycle repeats itself each time power is supplied to the bale breakers 11 or conveyor 12.

The use of the above described apparatus and method of the invention has produced a number of advantages as established by reliable mill and laboratory tests. These include: (1) the control of lint fly throughout the mill; (2) the elimination of sticking caused by high-sugar content, seed fragments and other contamination; (3) an increase in the removal of dirt and other foreign matter in the preparatory stages, without increasing the loss of spinnable fibers; (4) the elimination of static electricity; (5) a reduction in fiber breakage; (6) the production of a more compact and smoother picker lap with no change in the logger-head pressure; and (7) the production of yarn having a significant increase in yarn strength, and a reduction in the yarn strength range. Other advantages realized from the use of the invention are: (8) a reduction of down-time caused by ends-down in processing; (9) an increase in the apparent fiber tenacity of the yarns produced; (10) extended life of mill machinery resulting from reducing the fiber-to-metal friction; (11) better preparation of laps and slivers; and (12) the reduction of comber-noil with no loss in yarn quality.

A particular feature of the above described apparatus is the positive control of the spray station through the distributing equipment which eliminates waste of the treatment composition and which assures positive control of the spray of the treatment composition to the fibers when the fibers are passing the spray station. The spray station then operates in response to the presence of fiber material, but the control is a positive control acting directly in response to the feeding of material onto the conveyor at point spaced from the spray station.

While the preferred embodiments of the invention have been illustrated and described, it will be understood by those skilled in the art that changes and modifications may be resorted to without departing from the spirit and the scope of the invention.

What is claimed is:

1. Apparatus for treating fibrous material in a textile mill comprising a conveyor;

powered apparatus for opening fibrous material and for distributing said material uniformly onto said conveyor;

spray apparatus including at least one nozzle for spraying a liquid on the fibrous material carried on said conveyor, and a pump driven by an electric motor for supplying liquid to said nozzle through a liquid supply conduit; said spray apparatus being positioned adjacent to said conveyor, at a location distant from said powered distributing apparatus;

and electric control means including an electric power circuit for said pump motor, and a time delay circuit responsive to the energization and deenergization of said powered distributing apparatus for energizing and deenergizing said power circuit after selected time intervals;

said time delay circuit comprising a. a delay start controller;

b. a delay stop controller;

c. circuit means for energizing and deenergizing said delay start controller responsive respectively to the energization and deenergization of said distributing apparatus; and d. circuit means for energizing and deenergizing said delay stop controller through said delay start controller;

said delay start controller being effective, when energized and after a preselected time delay, to close and energize said power circuit and to deenergize said delay stop controller; said delay stop controller being effective, when deenergized, to close said power circuit in parallel with said start controller;

said delay start controller being effective, when deenergized, to open said power circuit and to energize said delay stop controller; and said delay stop controller being effective, when energized and after a preselected time delay, to open and deenergize said spray apparatus power circuit to deenergize said spray apparatus.

2. Apparatus as set forth in claim 1 said spray apparatus further including a pressure responsive valve in said liquid supply conduit adjacent to said nozzle, which opens in response to a preselected pressure within said liquid supply conduit.

3. Apparatus as set forth in claim 1 said spray apparatus further including a shut off valve actuated by a solenoid in said liquid supply conduit, and a pressure responsive valve in sai liquid supply conduit adjacent to said nozzle which opens in response to a preselected pressure within said liquid supply conduit;

and said electric power circuit further including said valve solenoid.

4. Apparatus as set forth in claim 2 an air supply conduit connected to said nozzle; an air shut off valve actuated by a solenoid in said air supply conduit;

and said electric power circuit further including said air valve solenoid.

5. Apparatus for spraying liquid in timed relation to a remotely generated electric signal comprising spray apparatus including at least one spray nozzle, and a pump driven by an electric motor for supplying liquid to said nozzle through a liquid supply conduit;

and electric control means including an electric power circuit for said pump motor, and a time delay circuit responsive to a remotely generated electric signal for energizing and deenergizing said power circuit after selected time intervals;

said time delay circuit comprising a. a delay start controller;

b. a delay stop controller;

c. circuit means for energizing and deenergizing said delay start controller by said remotely generated electric signal;

d. and circuit means for energizing and deenergizing said delay stop controller through said delay start controller;

said delay start controller being effective, when energized and after a preselected time delay, to close and energize said power circuit and to deenergize said delay stop controller; said delay stop controller being effective, when deenergized, to close said power circuit in parallel with said start controller;

said delay start controller being effective, when deenergized, to open said power circuit and to energize said delay stop controller; and said delay stop controller being effective, when energized and after a preselected time delay, to open and deenergize said spray apparatus power circuit to deenergize said spray apparatus.

6. Apparatus as set forth in claim 5 said spray apparatus further including a pressure responsive valve in said liquid supply conduit adjacent to said nozzle, which opens in response to a preselected pressure within said liquid supply conduit.

7. Apparatus as set forth in claim 5 said spray apparatus further including a shut off valve actuated by a solenoid in said liquid supply conduit, and a pressure responsive valve in said liquid supply conduit adjacent to said nozzle which opens in response to a preselected pressure within said liquid supply conduit;

and said electric power circuit further including said valve solenoid.

8. Apparatus as set forth in claim 6 an air supply conduit connected to said nozzle; an air shut off valve actuated by a solenoid in said air supply conduit;

and said electric power circuit further including said air valve solenoid.

* * * * *